US008186973B2

(12) United States Patent
Rosenzweig et al.

(10) Patent No.: US 8,186,973 B2
(45) Date of Patent: May 29, 2012

(54) TUBULAR PUMP

(75) Inventors: Maximilian Rosenzweig, Montreal (CA); Ognjen Vrdoljak, Laval (CA)

(73) Assignee: Euro-Pro Operating LLC, Newton, MA (US)

( * ) Notice: Subject to any disclaimer, the term of this patent is extended or adjusted under 35 U.S.C. 154(b) by 686 days.

(21) Appl. No.: 12/421,261

(22) Filed: Apr. 9, 2009

(65) Prior Publication Data

US 2010/0040489 A1 Feb. 18, 2010

Related U.S. Application Data

(60) Provisional application No. 61/088,771, filed on Aug. 14, 2008.

(51) Int. Cl.
*F04B 43/09* (2006.01)
*F04B 43/08* (2006.01)

(52) U.S. Cl. ..... 417/412; 417/474

(58) Field of Classification Search ..... 417/412, 417/474, 476, 478, 313
See application file for complete search history.

(56) References Cited

U.S. PATENT DOCUMENTS 3,103,178 A * 9/1963 Thompson ..... 417/477.1
2007/0068969 A1 * 3/2007 Orzech et al. ..... 222/214
* cited by examiner

*Primary Examiner* — Toan Ton
*Assistant Examiner* — Elmito Breval
(74) *Attorney, Agent, or Firm* — Wolf, Greenfield & Sacks, P.C.

(57) ABSTRACT

A tubular fluid pump is provided. The pump includes a chamber for receiving and discharging fluid, and a squeezing mechanism for pumping fluid through the chamber. The chamber has a first end with a first opening, a second end with a second opening, and a length of resilient tubular material extending between the first and second openings. One-way valves disposed at the openings cooperate to permit fluid to pass through the chamber in only one axial direction. The squeezing mechanism includes a substantially rigid base and a substantially rigid displaceable actuator. The tubular material is mounted on the base of the squeezing mechanism, and the actuator is aligned to alternately squeeze the tubular material against the base to pump fluid out of the chamber, and release the tubular material from the base to draw fluid into the chamber. A steam appliance incorporating a one-way tubular pump is also provided.

28 Claims, 9 Drawing Sheets

TUBULAR PUMP

CROSS-REFERENCE TO RELATED APPLICATION

This application is based on and claims the benefit of provisional patent application Ser. No. 61/088,771 filed Aug. 14, 2008. The entire content of the foregoing provisional patent application is incorporated herein by reference.

BACKGROUND OF THE INVENTION

1. Technical Field

The invention relates generally to apparatus, systems and method for pumping fluids. More particularly, the invention relates to apparatus, systems and methods for pumping water from a reservoir to a boiler for generating steam, including for use in the context of a steam appliance.

2. Background Art

Conventional mops have been widely used for cleaning floors. However, conventional mops have not been effective at cleaning dirt in small crevices and floor gaps. In addition, conventional mops require frequent rinsing since mops can only effectively clean a small surface area at a time.

Steaming devices used to apply steam to household objects are well known. The uses of the devices vary widely, and may include the application of steam to drapes or other fabrics to ease wrinkles, and the application of steam to objects to assist in cleaning the objects.

In general, nozzles used with the steam cleaners do not have large surface areas and a cloth is used to absorb the liquid condensate of the steam. The fabric pad may be secured to the nozzle by Velcro® strips to cleats on the bottom of the nozzle. Alternatively, a flat fabric piece is typically folded around a flat brush or frame in order to increase the cleaning surface area. Often, steam injected behind the cloth passes through the cloth at the points where the bristles contact the cloth. This tends to wet the cloth and reduce the cleaning effectiveness of the steam.

Recently introduced steam mops pump water from a reservoir to a boiler by the push-pull movement of the mop handle. Movement of the mop actuates a bellows pump or piston pump connected directly to the handle. These features are shown and described in copending non-provisional patent application Ser. Nos. 11/496,143 and 11/769,525. The entire content of each of the foregoing non-provisional patent applications is incorporated herein by reference.

It remains desirable to provide improved ways to pump water from the reservoir to the steam boiler in a steam appliance. These and other needs are addressed by the apparatus, systems and methods of the invention.

SUMMARY OF THE INVENTION

Generally speaking, in accordance with the invention, a one-way tubular water pump for selectively injecting water from a reservoir to a boiler in a steam appliance is provided. The pump includes a length of flexible tubing or hose having a one-way inlet valve at the inlet of the hose connected to a water reservoir and a one-way outlet valve at the connected to a steam generator. Steam generated in a steam appliance is fed to a steam frame. The pump is actuated by squeezing the hose with a piston, roller, shoe, or eccentric shaft. A steam fabric pad or towel may be mounted on the steam frame for cleaning.

Movement of the appliance actuates a piston or other actuator. Movement of the appliance may engage a switch to turn on a motor to rotate a wheel or move the piston to engage the pump hose to pump water to the boiler.

Accordingly, it is an object of the invention to provide a pump of simplified construction for use in a steam appliance.

Another object of the invention is to provide an improved pump for a steam appliance that is actuated to pump water to the boiler.

Still other objects and advantages of the invention will in part be obvious and will in part be apparent from the specification.

In accordance with an exemplary embodiments of the invention, a tubular fluid pump is provided that includes a chamber for receiving and discharging fluid, and a squeezing mechanism configured to interoperate with the chamber to pump fluid through it. The chamber includes walls defining a first end, a first opening associated with the first end, a second end opposite the first end, and a second opening associated with the second end. The walls of the chamber also define a length of resilient tubular material extending between the first and second openings, and in fluid communication with each of the openings. The chamber further includes respective first and second one-way valves disposed at the first and second openings. The first and second one-way valves cooperate to permit fluid to pass through the chamber in only one axial direction from the first opening to the second opening. The squeezing mechanism includes a substantially rigid base and a substantially rigid displaceable actuator. The length of resilient tubular material is mounted on the base. The actuator is aligned to alternately squeeze the length of resilient tubular material against the base to pump fluid out of the chamber via the second opening, and release the length of resilient tubular material from the base to draw fluid into the chamber via the first opening.

The actuator may define an impingement surface for contacting and squeezing the length of resilient tubular material against the reaction surface. Such impingement surface may be curved in shape along an axis of extension defined by the length of resilient tubular material.

The base may define a reaction surface for physically supporting the length of resilient tubular material against force imparted by the actuator. The length of resilient tubular material and the reaction surface that supports it may be substantially straight in shape along an axis of extension defined by the length of resilient tubular material. Alternatively, the length of resilient tubular material and the reaction surface that supports it may be substantially curved in shape along the axis of extension defined by the length of resilient tubular material.

The actuator may reciprocate toward and away from the reaction surface to alternately squeeze and release the length of resilient tubular material. The actuator may be mounted with respect to the base, and the tubular fluid pump may further include a motor, such as a stepper motor, mounted to the base for moving the actuator relative to the reaction surface.

The actuator may be mounted to the base via the motor. For example, the motor may be a pusher motor for urging the actuator toward and away from the reaction surface along a path of motion defining a straight axis. Alternatively, the motor may operate so as to rotate a shaft and define an axis of rotation, in which case the motor rotates the actuator about the axis of rotation defined by the motor.

Alternatively, the actuator may be rotatably mounted to the base so as to define a hinge axis. The tubular fluid pump may further include a cam shaft, and a camming surface associated with the cam shaft. For example, the tubular fluid pump may include a roller mounted to the cam shaft, and the roller may include and define the camming surface. The motor may operate to rotate the cam shaft, and the camming surface may operate to contact the actuator and urge the actuator to rotate about the hinge axis. The cam shaft may include a plurality of such camming surfaces (e.g., six such camming surfaces) for separately contacting and urging the actuator. The camming surfaces of the plurality may define a regular array, equally peripherally spaced about the axis of rotation associated with the motor.

The actuator may define an impingement surface for contacting and squeezing the length of resilient tubular material against the reaction surface. For example, the actuator may operate to reciprocate toward and away from the reaction surface such that the impingement surface translates toward and away from the reaction surface along a path of movement defining a straight axis. Such straight axis may be oriented substantially perpendicular to an axis of extension defined by the length of the resilient material. For another example, the actuator may reciprocate toward and away from the reaction surface such that the actuator rotates relative to the reaction surface, and the impingement surface defines at least a segment of a circle (e.g., less than a full circle, or a full circle). When the impingement surface of the actuator contacts and squeezes the length of resilient tubular material against the reaction surface, such circle segment may be oriented substantially perpendicular to an axis of extension of the length of resilient tubular material.

The base of the tubular fluid pump may define a reaction surface for supporting the length of resilient tubular material against force imparted by the actuator, and the actuator may be movably mounted to the base.

The actuator may be a piston. For example, the piston may be operatively connected to a handle to actuate the piston by movement of the handle.

In accordance with exemplary embodiments of the invention, a steam appliance is provided. The steam appliance includes a housing having a water reservoir, a boiler, and a one-way tubular pump for pumping water from the reservoir into the boiler. The one-way tubular pump may include a chamber for receiving and discharging fluid, and a squeezing mechanism configured to pump fluid through the chamber. The chamber may include walls defining a first opening for receiving fluid into the chamber, a second opening distal the first opening for discharging fluid from the chamber, and a length of resilient tubular material in fluid communication with each of the first and second openings and extending axially therebetween. The chamber may further include a first valve disposed at the first opening and a second valve disposed at the second opening. Each of the first valve and the second valve may be a one-way valve. The first and second valves may cooperate to permit fluid to pass through the chamber in only one axial direction from the first opening to the second opening. The squeezing mechanism may include a substantially rigid base on which the length of resilient tubular material is mounted, and a substantially rigid displaceable actuator aligned to alternately squeeze the length of resilient tubular material against the base to pump fluid out of the chamber via the second opening, and release the length of resilient tubular material from the base to draw fluid into the chamber via the first opening tubular pump. The actuator may be a piston. The piston may be connected to a handle to actuate the pump by movement of the handle. The steam appliance may further include a motor for displacing the piston.

In accordance with exemplary embodiments of the invention, a one-way tubular fluid pump is provided. The pump includes a substantially rigid base, a flexible length of tubular material having two ends mounted on a base, a one-way inlet valve connected to one end of the tubular material, a one-way outlet valve connected to the second end of the tubular material, and a substantially rigid displaceable actuator aligned to squeeze the tubular material against the base to pump fluid out the outlet valve and on release draw fluid into the inlet valve.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE INVENTION

Figure 1:
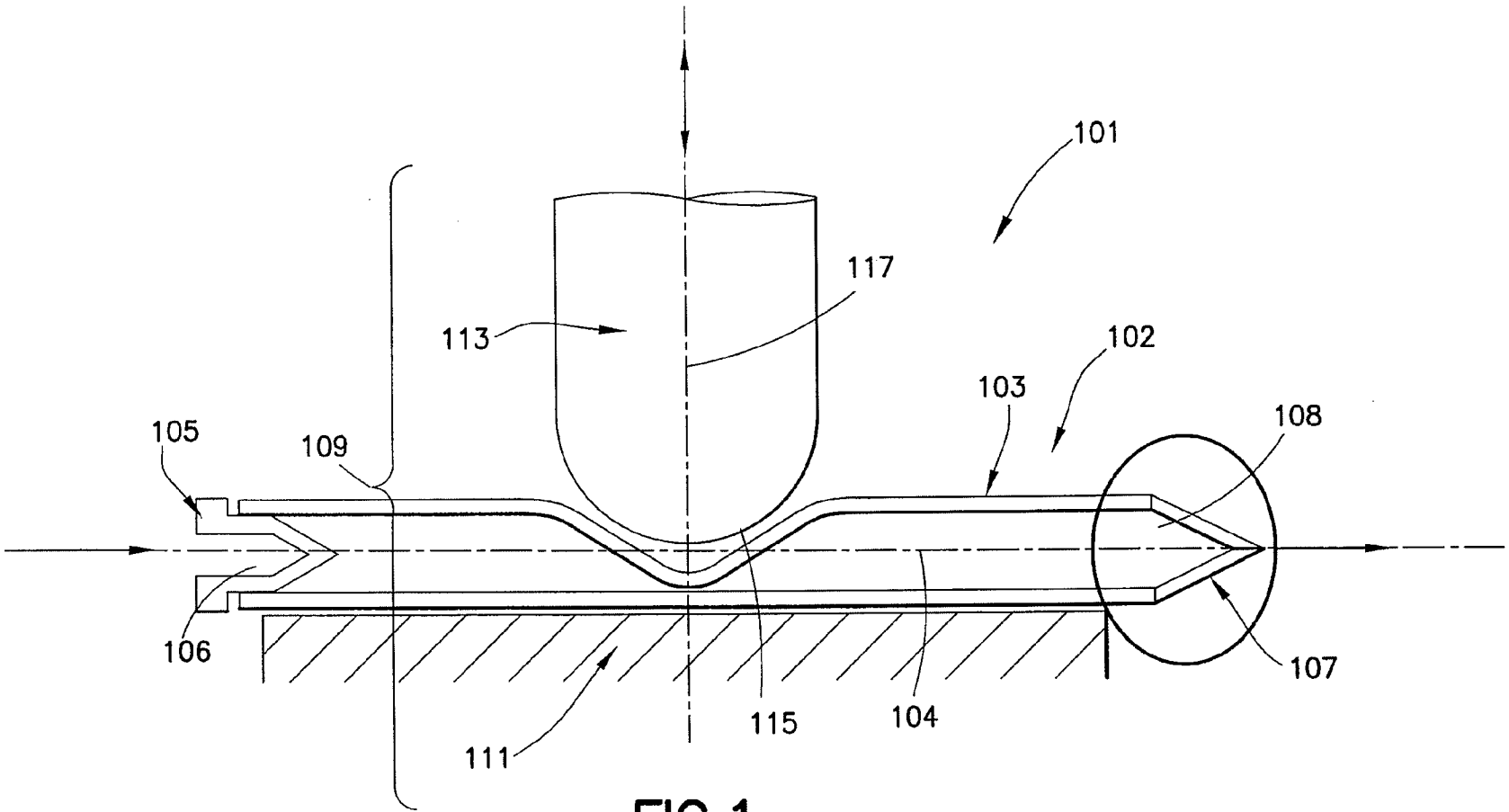
FIG. 1 is a schematic view in section of a pump constructed and arranged in accordance with the invention.

The disclosed apparatus, systems and methods include a pump 101, the operative pumping elements of which are shown in FIG. 1 in a sectional view. The pump 101 is a one-way tubular pump that includes a chamber 102 for receiving and discharging fluid. The chamber 102 includes walls defining a length of resilient tubular material forming a hose or tubular member 103. The hose 103 may include a length extent that defines an axial path or direction of extension 104 of the hose 103. The hose 103 may be made of soft material, flexible enough to permit the hose 103 to be deformed for purposes of allowing or causing fluid to be discharged from the chamber 102, but resilient enough to permit the hose 103 to re-assume its original shape in the absence of external squeezing forces for purposes of allowing or causing fluid to flow into the chamber 102. The hose 103 may be used as a cylinder for water transfer. The chamber 102 further includes a first valve 105 disposed at a first opening 106 defined by walls of the chamber 102 at a first end of the hose 103, and a second valve 107 disposed at a second opening defined by walls of the chamber 102 at a second end of the hose 103 opposite the first end thereof. Each of the first and second valves 105, 107 is a one-way valve (e.g., as indicated by corresponding respective instances of a sideways-oriented arrow appearing in FIG. 1), such that the first and second valves 105, 107 cooperate to permit fluid to pass through the hose 103 only in one direction. In accordance with some embodiments of the invention, including the embodiment thereof shown in FIG. 1, each of the first and second valves 105, 107 is a duck bill valve, wherein the first valve 105 is an inlet valve of the chamber 102 connectable to a water reservoir (not shown), the second valve 107 is an outlet valve of the chamber 102 connectable to a steam generator or boiler (not shown), and the second valve 107 is part of, or of unitary construction with, the hose 103. Other configurations are possible. For example, the second valve 107 may be a separate piece attached by any other means to the hose 103 and directed in the appropriate direction to permit water to pass only out of the pump 101.

The pump 101 further includes a squeezing mechanism 109 configured and adapted to interoperate with the chamber 102 to pump water through the chamber 102, including through the hose 103 and the first and second valves 105, 107 thereof, along the axial path or direction of extension 104 of the hose 103. In accordance with some embodiments of the invention, including the embodiment thereof shown in FIG. 1, the squeezing mechanism 109 may include a reaction surface 111 and a piston or cam 113. The cam 113 may include an impingement surface 115. In operation, the cam 113 may be caused to move in a reciprocating fashion toward and away from the reaction surface 111 along a path or direction of movement 117 (e.g., wherein the path or direction of movement 117 of the cam 113 is transverse or perpendicular to the path or direction of extension 104 of the hose 103), alternately squeezing the hose 103 against the reaction surface 111 to eject water outward of the chamber 102 via the second opening 108, and releasing the hose 103 from the reaction surface 111 to allow the hose 103 to expand again and thereby draw water into the chamber 103 via the first opening 106. In accordance with some embodiments of the invention, the size of the hose 103 may be at least one determining factor in the amount of water ejected from the chamber 102 via the second opening 108 every time the cam 113 squeezes the hose 103 against the reaction surface 111, and/or in the amount of water drawn into the chamber 102 via the first opening 106 every time the cam 113 releases the hose 103 from the reaction surface 111.

The reaction surface 111 may be a hard surface. For example, the reaction surface 111 may be part of or incorporated in a larger structure (not otherwise shown) comprising a substantially rigid base on which at least a portion of the hose 103 of the chamber 102 is mounted. The reaction surface 111 may be sized, shaped, configured and dimensioned cooperatively with respect to the shape of the hose 103 to facilitate pumping action. For example, in embodiments (not separately shown) of the invention in which the shape of the reaction surface 111 is curved along the axial direction of extension 104 of the hose 103, the curved shape of the reaction surface may be limited by a minimum bending radius associated with the hose 103.

In accordance with some embodiments of the invention, the cam 113 may be caused to move up and down in response to corresponding movement of an appliance (not otherwise shown in FIG. 1) in which the pump 101 is incorporated. For example, the cam 113 may be caused to squeeze and release the hose 103 in tandem with such normal movement or flexure of such appliance (not otherwise shown in FIG. 1) as may tend to occur during the ordinary course of use of such appliance by an end user or operator thereof.

In accordance with some embodiments of the invention, the cam 113 may be any size or shape suitable to permit the cam 113 to be used in cooperation with the reaction surface 111 and the hose 103. In accordance with some embodiments of the invention, including the embodiment thereof shown in FIG. 1, the impingement surface 115 of the cam 113 is curved. In such circumstances, the impingement surface 115 may define a curve radius large enough to reduce a potential for undue wear in the hose 103, potentially advantageously increasing a useful life of the pump 101. In accordance with some embodiments of the invention, the impingement surface 115 and the reaction surface 111 are configured and dimensioned cooperatively with respect to each other, potentially advantageously increasing or maximizing a volume of water ejected by the pump 101 each time the hose 103 is squeezed between the cam 113 and the reaction surface 111.

Figure 2:
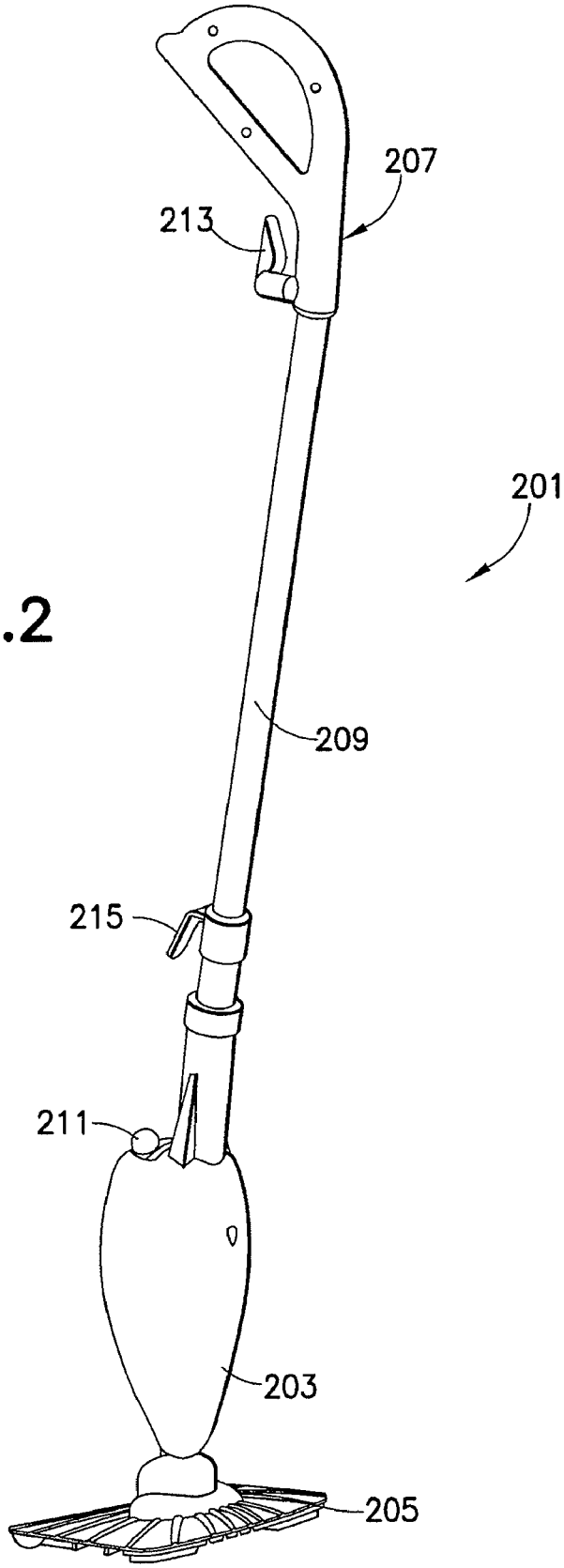
FIG. 2 is a perspective view of a steam mop including a pump in accordance with the invention.

As shown in perspective view in FIG. 2, the disclosed apparatus, systems and methods include a steam mop 201. The mop 201 may include a housing or main body 203. The housing 203 may be connected to a steam pad frame 205. A fabric steam pad (not shown) is typically placed over the steam pad frame 205 for effective steam cleaning. The mop 201 may include a handle 207 connected to one end of a pipe 209. The housing 203 may be connected to an opposite end of the pipe 209. The mop 201 may include an opening 211 that may be easily opened and closed to allow a user to fill the housing 203 with water. The mop 201 may include respective upper and lower cord hangers 213, 215 respectively mounted with respect to the handle 207 and the pipe 209 for easy storage of a power cord (not separately shown).

The mop 201 may include (e.g., within the housing 203) an instance, an embodiment, a variation, or a modified version (not separately shown) of the pump 101 shown and described herein with reference to FIG. 1 at least operatively connected to the pipe 209 such that movement of the pipe 209 results in pump actuation. In accordance with some such embodiments of the mop 201, the pipe 209 is mounted with respect to the housing 203 such that the pipe 209 is allowed to reciprocate, piston-like, relative to the housing 203, such that as a user pushes and pulls on the handle 207 during normal use of the mop 201, the pump 101 (not shown) is repeatedly actuated, and a steady flow of steam is produced.

Figure 3:
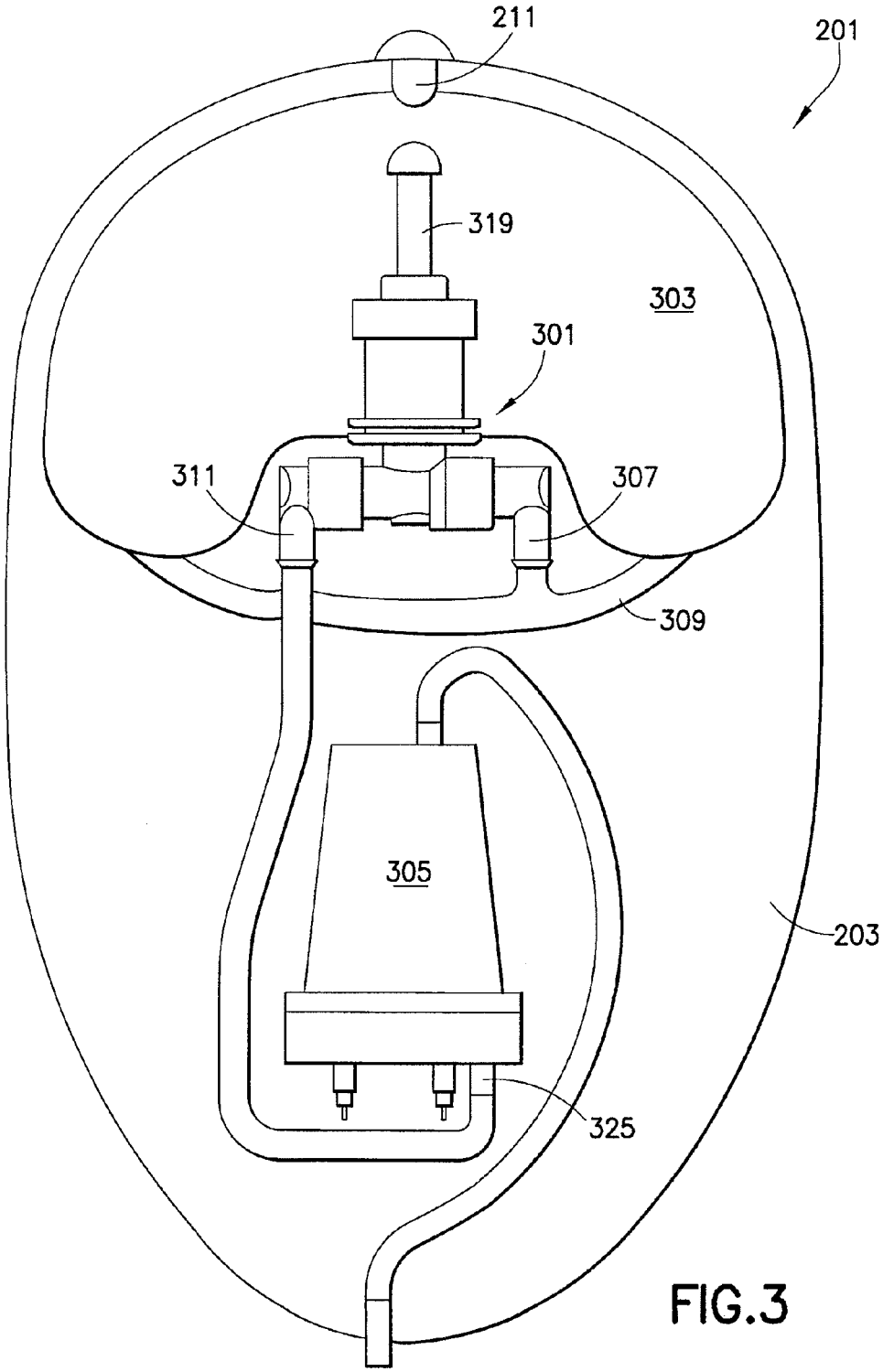
FIG. 3 is a front plan view of the housing of the steam mop of FIG. 2.
Figure 4:
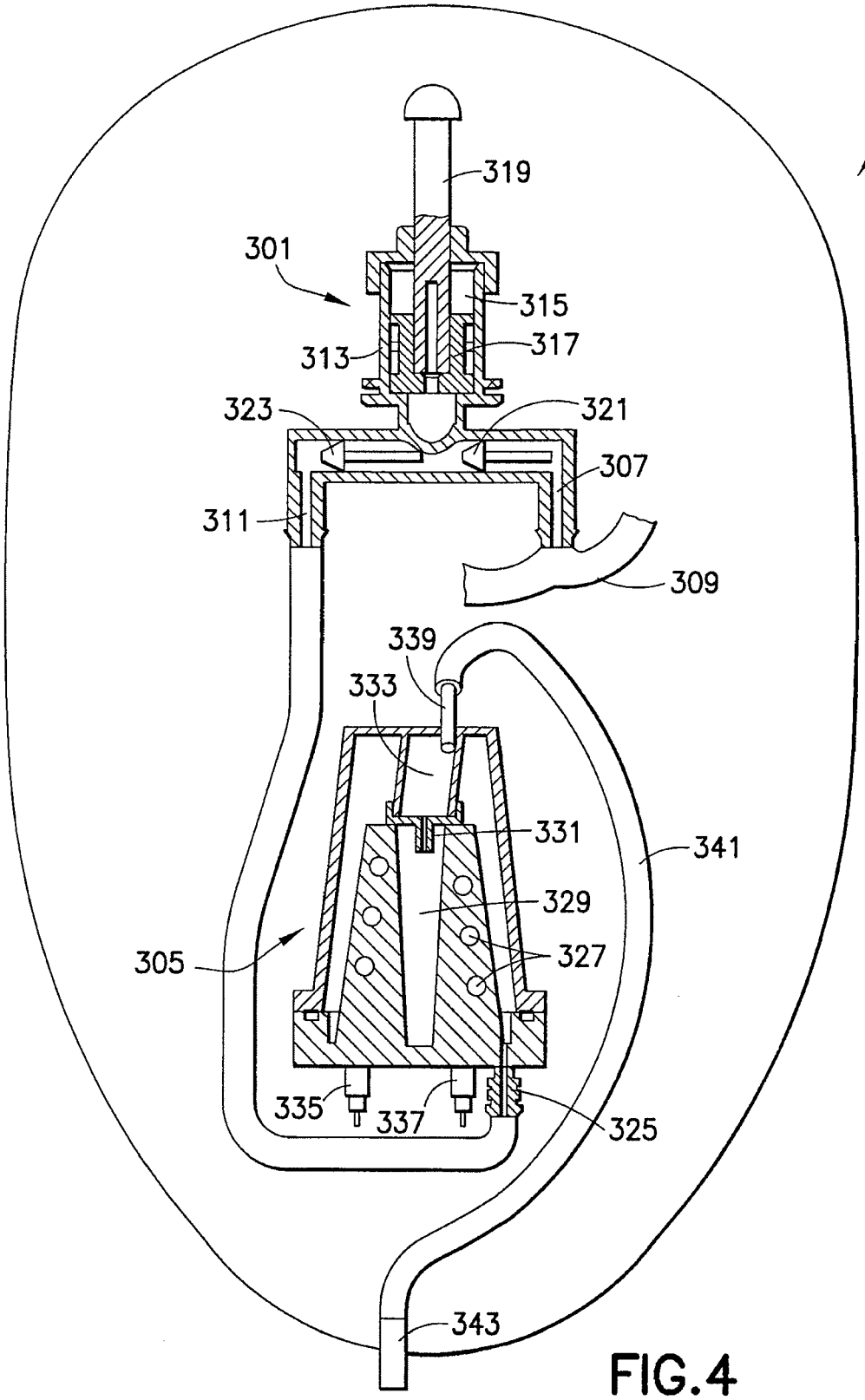
FIG. 4 is a sectional view of elements of the steam mop of FIG. 2.

As discussed above, the mop 201 may include (e.g., within the housing 203) an instance, an embodiment, a variation, or a modified version of the pump 101 of FIG. 1. As shown in FIGS. 3 and 4 and discussed below, the mop 201 may include a pump 301. The pump 301 of FIGS. 3 and 4 may have a construction that is the same or similar to the above-described construction at of the pump 101 of FIG. 1. The pump 301 of FIGS. 3 and 4 may function in a way that is the same or similar to the above-described manner in which the pump 101 of FIG. 1 functions. The pump 301 of FIGS. 3 and 4 and the pump 101 of FIG. 1 may differ to at least some extent in terms of their respective specific structure and function. The structure and function of the pump 301 of FIGS. 3 and 4 is discussed in greater detail below.

FIGS. 3 and 4 include respective front plan and section views of elements in the housing 203 of the mop 201. The mop 201 may include a water container or tank 303, the pump 301 (as discussed above), and a boiler 305. The mop 201 may include a pump water inlet 307, and a water supply hose 309 connected thereto. The mop 201 may include pump water outlet 311. The pump water outlet 311 may be connected to the boiler 305. The opening 211 (discussed above, see FIG. 2) allows a user to fill water into the water container 303.

The pump 301 may include a pump body 313 defining a pump cavity 315. A piston 317 may be connected to a push rod 319 positioned in the cavity 315. As the mop handle 111 (FIG. 2) is pulled by a user, the push rod 319 and the piston 317 create a negative pressure in the cavity 315. This draws water from the tank 303 into the water supply hose 309 and into the pump water inlet 307. Water is then drawn through a one-way inlet valve 321. As the mop handle 111 (FIG. 2) is pushed during use, at least a portion of the water in the cavity 315 is expelled through a one-way outlet valve 323 and the pump water outlet 311. This pumped water then passes to a boiler inlet 325 on the boiler 305. Water in the boiler 305 is heated by a heating element 327 in a boiler cavity 329 and steam generated is fed through a steam valve 331 into a steam chamber 333. The heating element 327 may be connected to electrical connectors 335 and 337. Steam is then expelled through a steam outlet 339 to a steam hose 341 and to a frame connector 343.

The one-way inlet valve 321 and the one-way outlet valve 323 may be formed of a flexible elastomeric material, such as rubber. The valves may be conical in shape so that when the handle 207 (FIG. 2) is pulled, water is drawn through the inlet valve 321 while the outlet valve 323 remains closed. Similarly, when the handle 207 (FIG. 2) is pushed, water is forced out through the outlet valve 323, the inlet valve 321 remains closed, and water is fed into the boiler 305.

Figure 5:
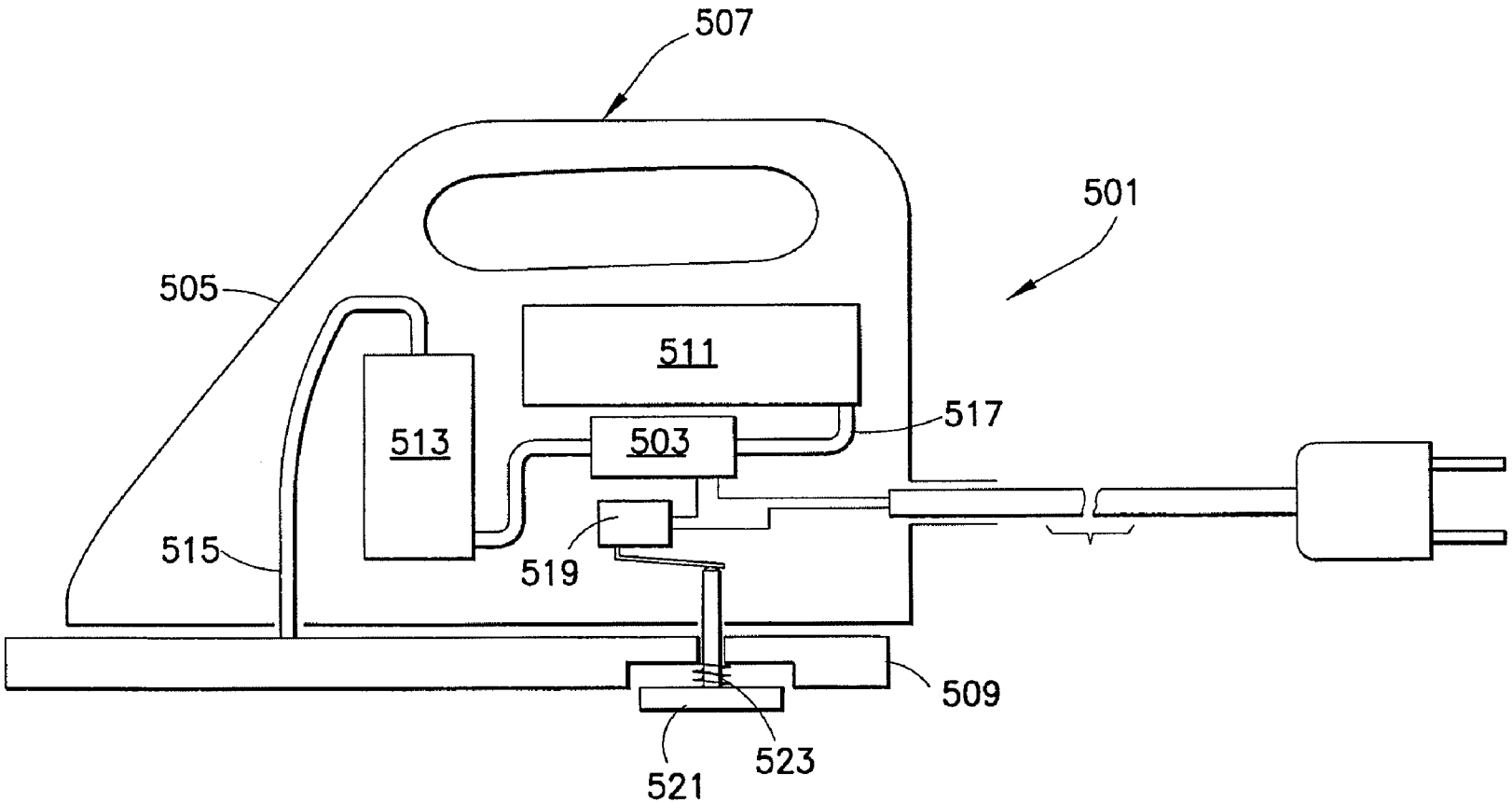
FIG. 5 is a sectional view of a hand-held steam appliance including a pump in accordance with the invention.

FIG. 5 shows a hand-held steam appliance 501 including a pump 503. In accordance with some embodiments of the invention, the pump 503 is an instance of the pump 101 shown and described above with respect to FIG. 1. The appliance 501 includes a housing 505 having a user handle 507 and a towel frame 509 or cleaning surface on the bottom. The internal elements of the appliance 501 may be similar to the internal elements of the mop 201 shown and described above with reference to FIG. 2 and include a water reservoir or tank 511 and a boiler 513 with a steam hose 515 connected to the towel frame 509.

Water in the reservoir 511 is fed to the pump 503 through an outlet hose 517 and then to the boiler 513. The pump 503 may be powered by electricity, and may be controlled by a micro switch 519. The micro switch 519 may be configured and adapted to be actuated from ON to OFF and vice versa by a switch actuator 521. The switch actuator 521 may be connected to a spring 523 that forces the switch actuator 521 to extend below the surface of the towel frame 509. The force of the spring 523 may be adjusted so that it is sufficient to extend the switch actuator 521 and at the same time actuate the micro switch 519 to the OFF position in any position when the appliance 501 is left unattended.

Once the appliance 501 is taken by a user to start the cleaning process, the weight of the user's hand and the force of pressure that the user applies to the appliance 501 is great enough to overcome the force of the spring 523, and to force the switch actuator 521 inward and at the same time actuate the micro switch 519 to the ON position. Actuating the micro switch 519 to the ON position starts the water delivery to the boiler 513 by activating the cam 113 (FIG. 1), causing water to be pumped to the boiler 513 and the steam generation process to start. The boiler 513 may be maintained hot from the moment when the appliance 501 is plugged into a wall outlet to reduce delay time between uses.

Once the cleaning process is stopped and the appliance 501 is left without any excessive weight, the spring 523 may extract the switch actuator 521 to interrupt the water delivery into the boiler 513 so that the steam process is stopped and the appliance 501 is turned OFF.

Each of the steam mop 201 with a one-way tubular pump and the hand-held appliance 501 with a one-way tubular pump provides many advantages for ease of use over other devices including a conventional electric water pump. In accordance with the invention, any movement of the handle 207 or 507 and mop head 205 or 509, respectively, allows the user more control over the amount of water to be discharged into the boiler. Similarly, as soon as the appliance 501 is used so that the switch actuator 521 engages the micro-switch 519, water is pumped to the heated boiler 513 for quick generation of steam. Both devices are designed as a low pressure or non-pressurized system so they are safe for use. Further, since the amount of water routed to the boiler is controlled, the boiler can create steam in a short amount of time.

Figure 6:
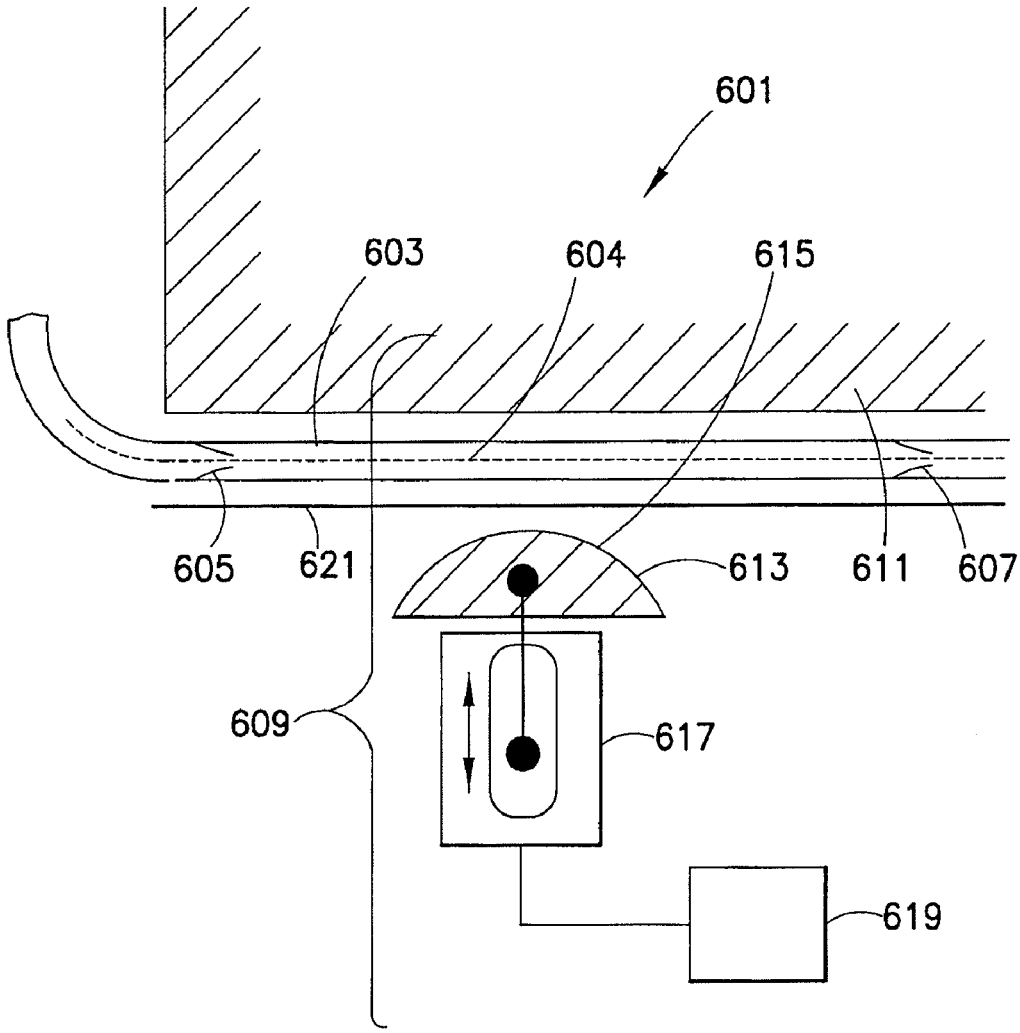
FIG. 6 is a schematic sectional view of another pump constructed and arranged in accordance with the invention.

The disclosed apparatus, systems and methods also include a pump 601, the operative pumping elements of which are shown in FIG. 6 in a sectional view. The pump 601 of FIG. 6 has a construction that is, to at least some extent, the same or similar to the above-described construction of the pump 101 of FIG. 1. The pump 601 of FIG. 6 functions in a way that is, to at least some extent, the same or similar to the above-described manner in which the pump 101 of FIG. 1 functions. The pump 601 of FIG. 6 and the pump 101 of FIG. 1 may differ to at least some extent in terms of their respective specific structure and function. The structure and function of the pump 601 of FIG. 6 is discussed in greater detail below.

The pump 601 is a one-way tubular pump that includes a hose or tubular member 603. The hose 603 may include a length extent that defines an axial path or direction of extension 604 of the hose 603. The hose 603 may be made of soft material. The hose 603 may be used as a cylinder for water transfer. The pump 601 further includes respective first and second valves 605, 607. Each of the first and second valves 605, 607 is a one-way valve, such that the first and second valves 605, 607 cooperate to permit water to pass through the hose 603 only in one direction. In accordance with some embodiments of the invention, including the embodiment thereof shown in FIG. 6, the first valve 605 is an inlet valve connectable to a water reservoir (not shown), and the second valve 607 is an outlet valve connectable to a steam generator or boiler (not shown).

The pump 601 further includes a squeezing mechanism 609 configured and adapted to interoperate with the hose 603 and the first and second valves 605, 607 to pump water through the hose 603, and through the first and second valves 605, 607, along the axial path or direction of extension 604 of the hose 603. In accordance with some embodiments of the invention, including the embodiment thereof shown in FIG. 6, the squeezing mechanism 609 may include a reaction surface 611 and a plunger 613. The plunger 613 may include an impingement surface 615.

The pump 601 may be powered by electricity. More particularly, the pump 601 may include a stepper or pushing motor 617 configured and arranged to push the plunger 613 toward and away from the hose 603 and the reaction surface 611 in a reciprocating fashion. The pump 601 may further include a controller 619 electrically coupled to the motor 617. The controller 619 may be used to control the amount of water pumped by the pump 601 by controlling the speed of the motor 617.

The pump 601 may include a membrane 621. As shown in FIG. 6, the membrane 621 is positioned between the plunger 613 and the hose 603. As discussed in greater detail below, the membrane 621 may remain between the plunger 613 and the hose 603 at all times during operation of the pump 601 to protect the hose 603 from such damage or degradation as might otherwise be caused by the plunger 613 and thereby contribute to a longer life of the hose 603. In accordance with some embodiments of the invention, the membrane 621 is strong enough to withstand repeated contact with the plunger 613, but is also relatively slippery, providing for smooth operation of the pump 601. For example, the membrane 621 may be formed from any slippery and flexible but otherwise appropriately tough polymeric/plastic material.

In operation, the plunger 613 may be caused to move in a reciprocating fashion toward and away from the reaction surface 611, alternately squeezing the hose 603 against the reaction surface 611 to eject water outward of the hose 603 via the second valve 607, and releasing the hose 603 from the reaction surface 611 to allow the hose 603 to expand again and thereby draw water into the hose 603 via the first valve 605.

In accordance with some embodiments of the invention, the plunger 613 may be caused to move up and down in response to corresponding movement of an appliance (not otherwise shown in FIG. 1) in which the pump 601 is incorporated. For example, the plunger 613 may be caused to squeeze and release the hose 603 in tandem with such normal movement or flexure of such appliance (not otherwise shown in FIG. 1) as may tend to occur during the ordinary course of use of such appliance by an end user or operator thereof.

In accordance with some embodiments of the invention, the plunger 613 may be any size or shape suitable to permit the plunger 613 to be used in cooperation with the reaction surface 611 and the hose 603. In accordance with some embodiments of the invention, including the embodiment thereof shown in FIG. 1, the impingement surface 615 of the plunger 613 is curved. In such circumstances, the impingement surface 615 may define a curve radius large enough to reduce a potential for undue wear in the hose 603, potentially advantageously increasing a useful life of the pump 601. In accordance with some embodiments of the invention, the impingement surface 615 and the reaction surface 611 are configured and dimensioned cooperatively with respect to each other, potentially advantageously increasing or maximizing a volume of water ejected by the pump 601 each time the hose 603 is squeezed between the plunger 613 and the reaction surface 611.

Figure 7:
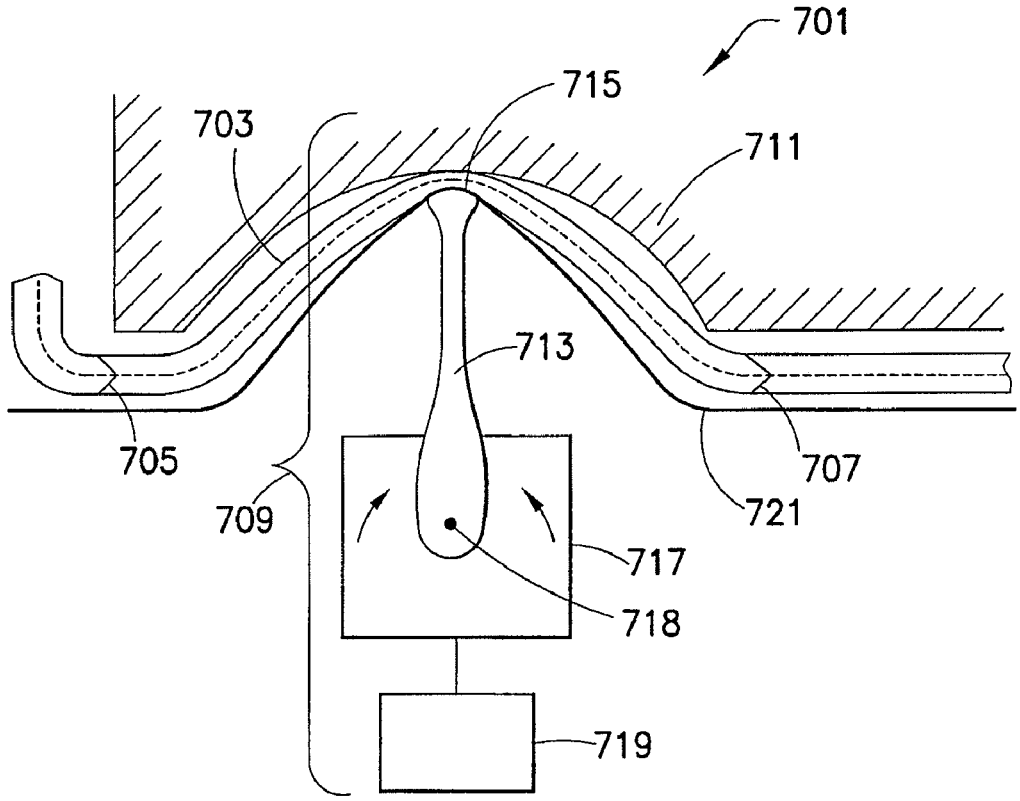
FIG. 7 is a schematic sectional view of yet another pump constructed and arranged in accordance with the invention.

The disclosed apparatus, systems and methods also include a pump 701, the operative pumping elements of which are shown in FIG. 7 in a sectional view. The pump 701 of FIG. 7 has a construction that is, to at least some extent, the same or similar to the above-described construction of the pump 101 of FIG. 1. The pump 701 of FIG. 7 functions in a way that is, to at least some extent, the same or similar to the above-described manner in which the pump 101 of FIG. 1 functions. The pump 701 of FIG. 7 and the pump 101 of FIG. 1 differ to at least some extent in terms of their respective specific structure and function. The structure and function of the pump 701 of FIG. 7 is discussed in greater detail below.

The pump 701 is a one-way tubular pump that includes a hose or tubular member 703. The hose 703 may include a length extent that defines an axial path or direction of extension 704 of the hose 703. The hose 703 may be made of soft material. The hose 703 may be used as a cylinder for water transfer. The pump 701 further includes respective first and second valves 705, 707. Each of the first and second valves 705, 707 is a one-way valve, such that the first and second valves 705, 707 cooperate to permit water to pass through the hose 703 only in one direction. In accordance with some embodiments of the invention, the first valve 705 is an inlet valve connectable to a water reservoir (not shown), and the second valve 707 is an outlet valve connectable to a steam generator or boiler (not shown).

The pump 701 further includes a squeezing mechanism 709 configured and adapted to interoperate with the hose 703 and the first and second valves 705, 707 to pump water through the hose 703, and through the first and second valves 705, 707, along the axial path or direction of extension 704 of the hose 703. In accordance with some embodiments of the invention, including the embodiment thereof shown in FIG. 7, the squeezing mechanism 709 may include a reaction surface 711 and a slider 713. The slider 713 may include an impingement surface 715.

The pump 701 may be powered by electricity. More particularly, the pump 701 may include a motor 717 configured and arranged to rotate the slider 713 about a rotation axis 718 and relative to the hose 703 and the reaction surface 711. The pump 701 may further include a controller 719 electrically coupled to the motor 717. The controller 719 may be used to control the amount of water pumped by the pump 701 by controlling the speed of the motor 717.

The pump 701 may include a membrane 721. As shown in FIG. 7, the membrane 721 is positioned between the slider 713 and the hose 703. As discussed in greater detail below, the membrane 721 may remain between the slider 713 and the hose 703 at all times during operation of the pump 701 to protect the hose 703 from such damage or degradation as might otherwise be caused by the slider 713 and thereby contribute to a longer life of the hose 703. In accordance with some embodiments of the invention, the membrane 721 is strong enough to withstand repeated contact with the plunger 713, but is also relatively slippery, providing for smooth operation of the pump 701. For example, the membrane 721 may be formed from any slippery and flexible but otherwise appropriately tough polymeric/plastic material.

In operation, the plunger 713 may be caused to rotate relative to the hose 703 and thereby cause the impingement surface 715 to move in a reciprocating fashion toward, past, and away from the reaction surface 711, alternately squeezing the hose 703 against the reaction surface 711 to eject water outward of the hose 703 via the second valve 707, and releasing the hose 703 from the reaction surface 711 to allow the hose 703 to expand again and thereby draw water into the hose 703 via the first valve 705.

In accordance with some embodiments of the invention, the slider 713 may be caused to rotate in response to corresponding movement of an appliance (not otherwise shown in FIG. 1) in which the pump 701 is incorporated. For example, the slider 713 may be caused to squeeze and release the hose 703 in tandem with such normal movement or flexure of such appliance (not otherwise shown in FIG. 1) as may tend to occur during the ordinary course of use of such appliance by an end user or operator thereof.

In accordance with some embodiments of the invention, including the embodiment thereof shown in FIG. 7, the reaction surface 711 is curved along the axial path or direction of extension 704 of the hose 703 to receive the hose 703 and to accommodate the rotating movement of the slider 713, and corresponding circular path of motion of the impingement surface 715. The impingement surface 715 may itself be curved so as reduce a potential for undue wear in the hose 703. In accordance with some embodiments of the invention, the circular path of motion of the impingement surface 715 and the curved profile and other dimensions of the reaction surface 711 are configured and dimensioned cooperatively with respect to each other, potentially advantageously increasing or maximizing a volume of water ejected by the pump 701 each time the hose 703 is squeezed between the slider 713 and the reaction surface 711.

Figure 8:
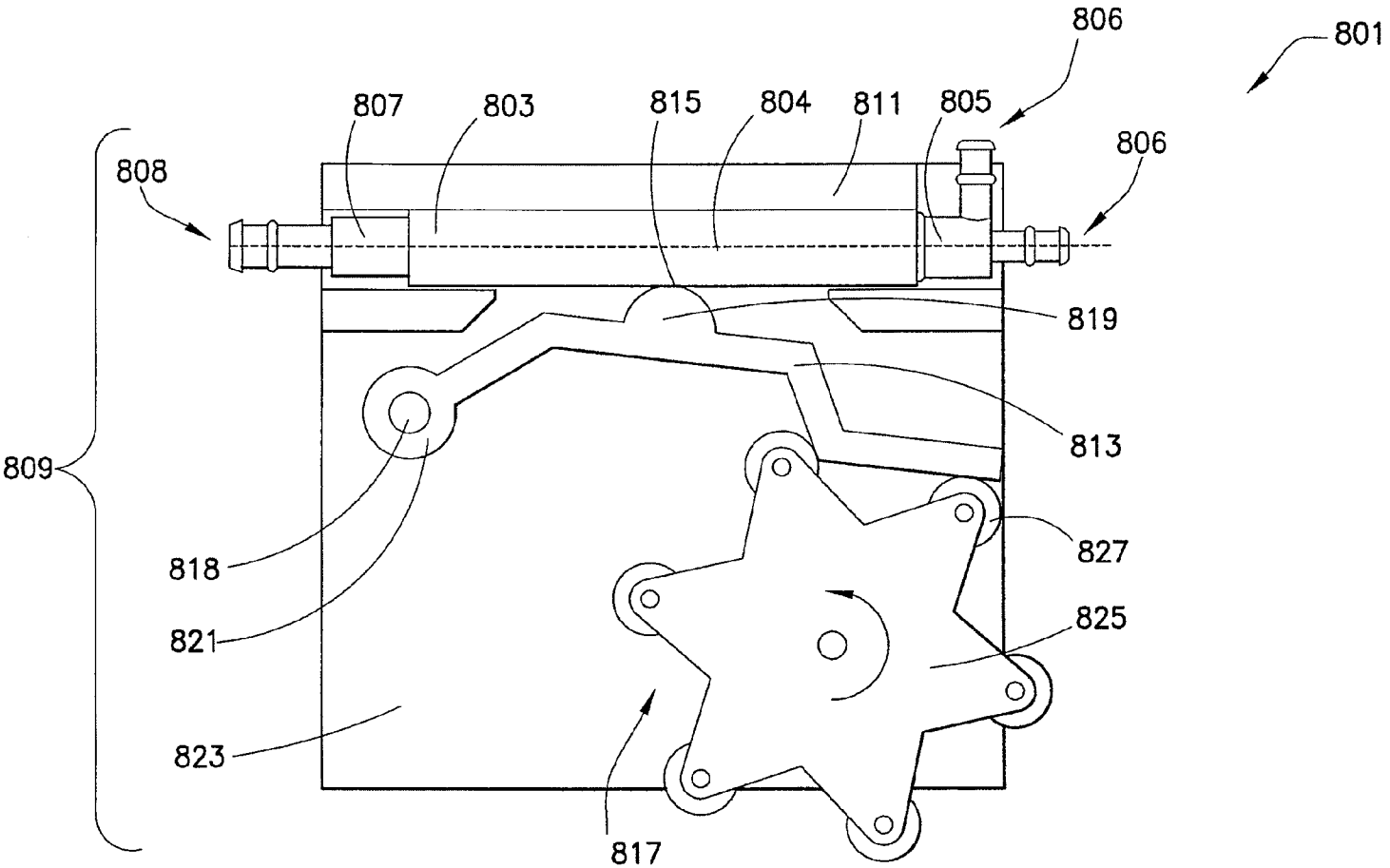
FIG. 8 is a schematic plan view of still another pump constructed and arranged in accordance with the invention.
Figure 9:
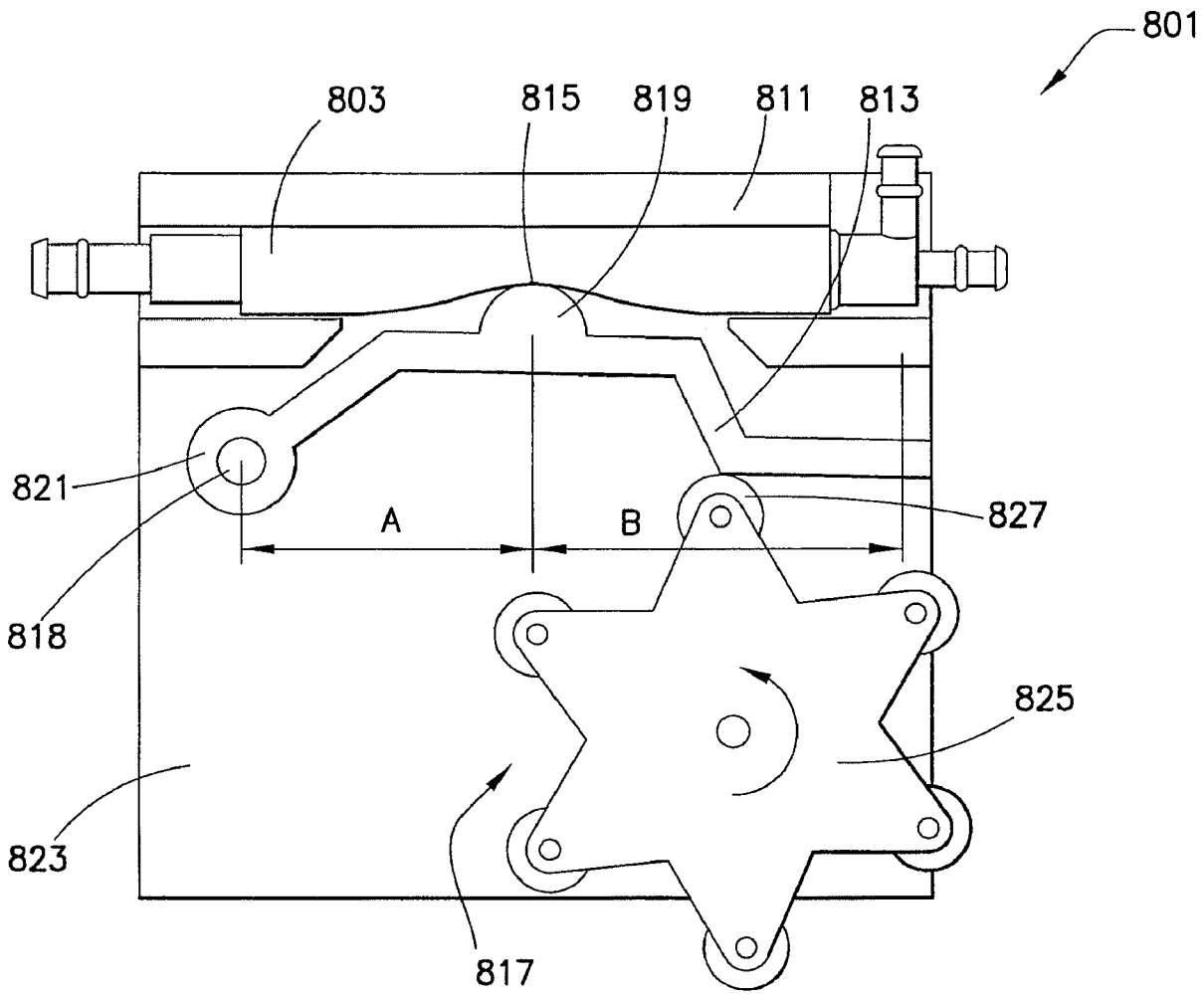
FIG. 9 is another schematic plan view of the pump of FIG. 8 illustrating the manner in which the pump of FIG. 8 operates to pump fluid.

The disclosed apparatus, systems and methods also include a pump 801, the operative pumping elements of which are shown in FIGS. 8 and 9 in respective plan views. The pump 801 of FIGS. 8 and 9 has a construction that is, to at least some extent, the same or similar to the above-described construction at of the pump 101 of FIG. 1. The pump 801 of FIGS. 8 and 9 functions in a way that is, to at least some extent, the same or similar to the above-described manner in which the pump 101 of FIG. 1 functions. The pump 801 of FIGS. 8 and 9 and the pump 101 of FIG. 1 differ to at least some extent in terms of their respective specific structure and function. The structure and function of the pump 801 of FIGS. 8 and 9 is discussed in greater detail below.

The pump 801 is a one-way tubular pump that includes a hose or tubular member 803. The hose 803 may include a length extent that defines an axial path or direction of extension 804 of the hose 803. The hose 803 may be made of soft material. The hose 803 may be used as a cylinder for water transfer. The pump 801 further includes respective first and second valves 805, 807 (obscured). Each of the first and second valves 805, 807 is a one-way valve, such that the first and second valves 805, 807 cooperate to permit water to pass through the hose 803 only in one direction. In accordance with some embodiments of the invention, the first valve 805 is an inlet valve connectable via one or more water inlets 806 to a water reservoir (not shown), and the second valve 807 is an outlet valve connectable via one or more water outlets 808 to a steam generator or boiler (not shown).

The pump 801 further includes a squeezing mechanism 809 configured and adapted to interoperate with the hose 803 and the first and second valves 805, 807 to pump water through the hose 803, and through the first and second valves 805, 807, along the axial path or direction of extension 804 of the hose 803. In accordance with some embodiments of the invention, including the embodiment thereof shown in FIG. 8, the squeezing mechanism 809 may include a reaction surface 811 and a hinged plunger 813. The hinged plunger 813 may include an impingement surface 815.

The pump 801 may be powered by electricity. More particularly, the pump 801 may include a motor 817 (obscured) configured and arranged to rotate or pivot the hinged plunger 813 about a rotation axis 818 and relative to the hose 803 and the reaction surface 811. The pump 801 may further include a controller (not shown) electrically coupled to the motor 817. The controller (not shown) may be used to control the amount of water pumped by the pump 801 by controlling the speed of the motor 817.

In accordance with some embodiments of the invention, including the embodiment thereof shown and described with reference to FIG. 8 (and, by comparison, e.g., to the embodiment thereof shown and described with reference to FIG. 7), the pump 801 includes no membrane positioned between the hinged plunger 813 and the hose 803. To extend the life expectancy of the hose 803, any rubbing action on the hose surface should be reduced to the smallest extent possible, if not eliminated entirely. As will be discussed in further detail hereinafter, the hinged plunger 813 includes a plunger nipple 819 that defines the impingement surface 815 of the hinged plunger 813, and the rotation axis 818 and the radial distance of the plunger nipple 819 from the rotation axis 818 are positioned and dimensioned in such a way as to ensure that the motion of the hinged plunger 813 is and remains substantially perpendicular to the hose surface during contact therebetween. Such an arrangement significantly limits friction between the hose 803 and the impingement surface 815 of the hinged plunger 813, thereby significantly reducing if not effectively eliminating friction caused by rubbing.

The design of the pump 801 is flexible, facilitating the creation of multiple versions of the pump 801 with different motor sizes without effect on the water flow per unit of time. The water flow of the pump 801 can be easily changed just by changing the dimensions of the hinged plunger 813 without changing all the parts in the assembly.

As indicated above, the hinged plunger 813 is attached on one end 821 to a housing 823 via a pivot or hinge which enables the hinged plunger 813 to rotate about the rotation axis 818. The hinged plunger 813 and the plunger nipple 819 can be made with a variety of different dimensions (length, height), allowing the use of motors with various amounts of power and torque. Since such an arrangement constitutes a lever design, different length ratios may be used to allow the use of a smaller motor which essentially allows for smaller size and, in some cases at least, a less expensive assembly. The hinged plunger 813 may be made from a variety of different materials, affording an ease of design with the potential to extend the life of the entire pump assembly.

In accordance with embodiments of the present disclosure, a ratio between distance A and distance B determines the motor torque necessary to rotate a cam shaft 825. The smaller the ratio A/B the smaller the necessary motor torque. Such an arrangement advantageously provides many more design options in motor choices. For example, the motor 817 may be a small stepper motor. Stepper motors are well known for reliability and precise control of speed and direction of rotation. In embodiments of the present invention in which the motor 817 is a stepper motor, a combination of low speed with high torque in the stepper motor provides relative freedom of design with respect to the cam shaft 825. In accordance with embodiments of the invention, the cam shaft 825 is made with six (6) points of contact, comprising the curved surfaces of six (6) rollers 827. With the use of a stepper motor for motor 817, the direction of rotation of the cam shaft 825 can be changed if desired. Moreover, the use of only one point of contact is possible, providing an efficient design that enables user-controlled water flow.

Referring now to FIGS. 8 and 9 in sequence, in operation, a roller 827 rotates into contact with the hinged plunger 813, and rolls therealong, rotating the hinged plunger 813 counterclockwise, and causing the impingement surface 815 of the plunger nipple 819 to squeeze the hose 803 against the reaction surface 811, causing water to be discharged from the hose 803. As the roller 827 continues to rotate, the plunger nipple 819 begins to descend as the hinged plunger 813 starts rotating clockwise, causing water to be drawn into the hose 803. Continued rotation of the cam shaft 825 in the counterclockwise direction causes the cycle to start again by producing a similar interaction between the hinged plunger 813 and the next roller of the six rollers associated with the cam shaft 825. As such, the pump 801 may function as a reciprocating pump.

In accordance with some embodiments of the invention, the hinged plunger 813 may be caused to rotate/reciprocate in response to corresponding movement of an appliance (not otherwise shown in FIG. 1) in which the pump 801 is incorporated. For example, the hinged plunger 813 may be caused to squeeze and release the hose 803 in tandem with such normal movement or flexure of such appliance (not otherwise shown in FIG. 1) as may tend to occur during the ordinary course of use of such appliance by an end user or operator thereof.

It will thus be seen that the objects set forth above, among those made apparent from the preceding description, are effectively attained and, since certain changes may be made in the above product without departing from the spirit and scope of the present invention, it is intended that all matter contained in the above description and shown in the accompanying drawings shall be interpreted as illustrative and not in a limiting sense.

The present invention may be embodied in other specific forms without departing from the spirit or essential attributes of the invention. Accordingly, reference should be made to the appended claims, rather than the foregoing specification, as indicating the scope of the invention.

What is claimed is:

1. A tubular fluid pump, comprising: a chamber for receiving and discharging fluid, the chamber including walls defining a first opening for receiving fluid into the chamber, a second opening distal the first opening for discharging fluid from the chamber, and a length of resilient tubular material in fluid communication with each of the first and second openings and extending axially there between, the chamber further including a first valve disposed at the first opening and a second valve disposed at the second opening, each of the first valve and the second valve being a one-way valve, the first and second valves being cooperatively configured and oriented to permit fluid to pass through the chamber in only one axial direction from the first opening to the second opening; and a squeezing mechanism configured to interoperate with the chamber to pump fluid there through, the squeezing mechanism including a substantially rigid base on which the length of resilient tubular material is mounted, and a substantially rigid displaceable actuator aligned to alternately squeeze the length of resilient tubular material against the base to pump fluid out of the chamber via the second opening, and release the length of resilient tubular material from the base to draw fluid into the chamber via the first opening, wherein the base defines a reaction surface for physically supporting the length of resilient tubular material against force imparted thereto by the actuator, and wherein each of the length of resilient tubular material and the reaction surface physically supporting same is substantially curved in shape along a corresponding axis of extension defined by the length of resilient material.

2. The tubular fluid pump of claim 1, wherein the actuator defines an impingement surface for contacting and squeezing the length of resilient tubular material against the reaction surface, the impingement surface being substantially curved in shape along a corresponding axis of extension defined by the length of resilient tubular material.

3. The tubular fluid pump of claim 1, wherein the base defines a reaction surface for physically supporting the length of resilient tubular material against force imparted thereto by the actuator, and wherein each of the length of resilient tubular material and the reaction surface physically supporting same is substantially straight in shape along a corresponding axis of extension defined by the length of resilient material.

4. The tubular fluid pump of claim 1, wherein the base defines a reaction surface for physically supporting the length of resilient tubular material against force imparted thereto by the actuator, and the actuator is configured and arranged to reciprocate toward and away from the reaction surface to alternately squeeze and release the length of resilient tubular material.

5. The tubular fluid pump of claim 4, wherein the actuator being configured and arranged to reciprocate toward and away from the reaction surface includes wherein the actuator is mounted with respect to the base, and wherein the tubular fluid pump further comprises a motor mounted to the base and operably coupled to the actuator so as to permit the motor to move the actuator relative to the reaction surface.

6. The tubular fluid pump of claim 5, wherein the motor is a stepper motor.

7. The tubular fluid pump of claim 5, wherein the actuator being mounted with respect to the base includes wherein the actuator is mounted to the motor, such that the actuator is mounted with respect to the base via the motor.

8. The tubular fluid pump of claim 7, wherein the motor is a pusher motor configured and adapted to urge the actuator toward and away from the reaction surface along a path of motion defining a straight axis.

9. The tubular fluid pump of claim 7, wherein the motor operates to rotate a shaft, thereby defining an axis of rotation, and wherein the motor is configured and arranged to rotate the actuator about the axis of rotation defined by the motor.

10. The tubular fluid pump of claim 5, wherein the actuator is rotatably mounted to the base so as to define a hinge axis, wherein the tubular fluid pump further comprises a cam shaft, and a camming surface associated with the cam shaft and configured and arranged to contact the actuator and urge the actuator to rotate about the hinge axis, and further wherein the motor operates to rotate the cam shaft so as to define an axis of rotation associated with the motor distal the hinge axis associated with the actuator.

11. The tubular fluid pump of claim 10, wherein the tubular fluid pump comprises a plurality of camming surfaces associated with the cam shaft, each camming surface of the plurality thereof being configured and arranged to contact the actuator and urge the actuator to rotate about the hinge axis separate from each other camming surfaces thereof.

12. The tubular fluid pump of claim 11, wherein the plurality of camming surfaces associated with the cam shaft define a regular array of camming surfaces substantially equally peripherally spaced about the axis of rotation associated with the motor.

13. The tubular fluid pump of claim 11, wherein the plurality of camming surfaces associated with the cam shaft includes respective first, second, third, fourth, fifth, and sixth camming surfaces, each camming surface of the first, second, third, fourth, fifth, and sixth camming surfaces being configured and arranged to contact the actuator and urge the actuator to rotate about the hinged axis separate from the other camming surfaces thereof.

14. The tubular fluid pump of claim 10, wherein the tubular fluid pump comprises a roller, the roller being mounted to the cam shaft, and the roller further including and defining the camming surface.

15. The tubular fluid pump of claim 4, wherein the actuator defines an impingement surface for contacting and squeezing the length of resilient tubular material against the reaction surface, and wherein the actuator being configured and arranged to reciprocate toward and away from the reaction surface includes wherein the impingement surface is configured and arranged to translate toward and away from the reaction surface along a path of movement defining a straight axis.

16. The tubular fluid pump of claim 15, wherein the straight axis defined by the path of movement of the impingement surface of the actuator is oriented substantially perpendicular to an axis of extension defined by the length of resilient material.

17. The tubular fluid pump of claim 4, wherein the actuator defines an impingement surface for contacting and squeezing the length of resilient tubular material against the reaction surface, and wherein the actuator being configured and arranged to reciprocate toward and away from the reaction surface includes wherein the actuator is configured and arranged to rotate relative to the reaction surface such that the impingement surface defines at least a segment of a circle.

18. The tubular fluid pump of claim 17, wherein the actuator being configured and arranged to rotate relative to the reaction surface includes wherein the at least a segment of a circle defined by the impingement surface of the actuator is oriented substantially perpendicular to an axis of extension defined by the length of resilient tubular material as the impingement surface of the actuator contacts and squeezes the length of resilient tubular material against the reaction surface.

19. The tubular fluid pump of claim 17, wherein the actuator being configured and arranged to rotate relative to the reaction surface such that the impingement surface defines at least a segment of a circle includes wherein the actuator is configured and arranged to rotate relative to the reaction surface such that the impingement surface defines a full circle.

20. The tubular fluid pump of claim 1, wherein the base defines a reaction surface for physically supporting the length of resilient tubular material against force imparted thereto by the actuator, and the actuator is movably mounted to the base.

21. The tubular fluid pump of claim 1, wherein the actuator is a piston.

22. The tubular fluid pump of claim 21, wherein the piston is operatively connected to a handle to actuate the pump by movement of the handle.

23. A steam appliance including a housing having a water reservoir, a boiler, and a one-way tubular pump for pumping water from the reservoir into the boiler.

24. The steam appliance of claim 23, wherein the one-way tubular pump includes a chamber for receiving and discharging fluid, and a squeezing mechanism configured to interoperate with the chamber to pump fluid therethrough, the chamber including walls defining a first opening for receiving fluid into the chamber, a second opening distal the first opening for discharging fluid from the chamber, and a length of resilient tubular material in fluid communication with each of the first and second openings and extending axially therebetween, the chamber further including a first valve disposed at the first opening and a second valve disposed at the second opening, each of the first valve and the second valve being a one-way valve, the first and second valves being cooperatively configured and oriented to permit fluid to pass through the chamber in only one axial direction from the first opening to the second opening, and the squeezing mechanism including a substantially rigid base on which the length of resilient tubular material is mounted, and a substantially rigid displaceable actuator aligned to alternately squeeze the length of resilient tubular material against the base to pump fluid out of the chamber via the second opening, and release the length of resilient tubular material from the base to draw fluid into the chamber via the first opening.

25. The steam appliance of claim 24, wherein the actuator is a piston.

26. The steam appliance of claim 25, wherein the piston is connected to a handle to actuate the pump by movement of the handle.

27. The steam appliance of claim 24, further including a motor for displacing the piston.

28. A one-way tubular fluid pump, comprising: a substantially rigid base; a flexible length of tubular material having two ends mounted on the base; a one-way inlet valve connected to one end of the tubular material; a one-way outlet valve connected to the second end of the tubular material; and a substantially rigid displaceable actuator aligned to squeeze the tubular material against the base to pump fluid out the outlet valve and on release draw fluid into the inlet valve, wherein the base defines a reaction surface for physically supporting the length of resilient tubular material against force imparted thereto by the actuator, and wherein each of the length of resilient tubular material and the reaction surface physically supporting same is substantially curved in shape along a corresponding axis of extension defined by the length of resilient material.

* * * * *